United States Patent [19]

Lein et al.

[11] 4,033,260

[45] July 5, 1977

[54] CONTROL SYSTEM FOR MULTI-COLOR ROTARY PRINTING MACHINES, ESPECIALLY FOR ALTERNATE ONE-SIDE AND TWO-SIDE PRINTING

[75] Inventors: Werner Lein; Kurt Reichenberger, both of Radebeul; Klaus Schanze, Coswig, all of Germany

[73] Assignee: VEB Polygraph Leipzig Kombinat fur Polygraphische Maschinen und Ausrustungen, Leipzig, Germany

[22] Filed: July 29, 1975

[21] Appl. No.: 600,070

[52] U.S. Cl. ..... 101/232; 101/18

[51] Int. Cl.[2] ..... B41F 36/16

[58] Field of Search ..... 101/230–232, 101/181–183

[56] References Cited

UNITED STATES PATENTS

| | | | |
|---|---|---|---|
| 3,613,576 | 10/1971 | Math et al. | 101/181 |
| 3,818,827 | 6/1974 | John et al. | 101/232 |
| 3,823,551 | 7/1974 | Riehl | 307/225 C |
| 3,874,391 | 4/1975 | Dogl et al. | 328/37 |
| 3,916,323 | 10/1975 | Moriyama et al. | 328/37 |

FOREIGN PATENTS OR APPLICATIONS

| | | | |
|---|---|---|---|
| 1,320,282 | 6/1973 | United Kingdom | 101/232 |

*Primary Examiner*—Edgar S. Burr
*Assistant Examiner*—William Pieprz
*Attorney, Agent, or Firm*—Michael J. Striker

[57] ABSTRACT

A sheet-representing signal is registered by successive shift-register stages in simulation of the travel of a sheet through a printing machine. Signal detectors connected to different register stages actuate moving units which in turn change the state of activation of the functional units of the printing machine. Upon a changeover from one-side to two-side printing, there arises a sheet travel path length change composed of a fixed component determined by machine geometry and a variable component determined by sheet length. Each moving unit moves cyclically and can move the associated functional unit only during a certain portion of the cycle. Upon a printing mode changeover, moving units undergo a phase shift of their cycles of motion and signal detectors are disconnected from certain register stages and reconnected to others, thereby compensating for the variable and fixed components of the sheet travel path length change.

1 Claim, 5 Drawing Figures

CONTROL SYSTEM FOR MULTI-COLOR ROTARY PRINTING MACHINES, ESPECIALLY FOR ALTERNATE ONE-SIDE AND TWO-SIDE PRINTING

BACKGROUND OF THE INVENTION

The invention relates to a control system for multicolor rotary printing machines, for example for alternative one-side and two-side printing.

One such control system is disclosed in German Democratic Republic Pat. No. 89115 and in corresponding U.S. Pat. No. 3,818,827. In that control system, the printing stations or individual functional units of the printing stations are activated in the proper sequence and with the proper timing by a control system comprised of a shift register. Each ON or OFF command signal is synchronized with the actual occurrence of the rotation and the phase within such rotation during which the commanded operation is to be performed. With this control system, there is a fixed coordination between certain rotations and phases within the rotations for the respective command signal for activating the associated functional group (e.g., for moving an offset cylinder into engagement with a printing cylinder, etc.) controlled by a signal detector activated by a change of signal of the associated shift-register stage.

With printing machines capable of alternative one-side or two-side printing, a control system exhibiting such fixed coordination cannot in general be employed. With such machines (disclosed for example in German Democratic Republic Pat. No. 54703, and in corresponding British Pat. No. 1,128,087), there occurs during one-sided printing a transfer of the sheet from the printing cylinder of one printing station via a transfer drum to a printing cylinder of the next printing station, with the leading edge (first printed end) of the sheet both times entering into the tangency point between the printing cylinders and the intermediate transfer drum. In other words, the same end of the sheet constitutes the leading end of the sheet both upon entry into the point of tangency between the first printing roller and the transfer drum and upon subsequent entry into the point of tangency between the transfer drum and the second printing roller. When changing over from one-side printing to two-side printing, the length of the path of sheet travel undergoes a change composed of a constant component dependent solely upon machine dimensions and of a variable component dependent upon the sheet format, i.e., upon the length of the sheet in the direction of sheet travel. Accordingly, when changing over from the one-side printing mode to the two-side printing mode, or vice-versa, there occurs a loss of coordination between, on the one hand, those functional units within the printing machine located downstream of the sheet-flipover location, and, on the other hand, the shift-register stages associated with those functional units in the printing mode previously employed. Because the control shift register is usually driven by a train of shifting signals synchronized with the cycles of machine operation (for example revolutions of a main shaft, such as a shaft of the transfer drum or of one of the printing cylinders, or some other rotary component of the machine), it is possible to express the just-mentioned loss of coordination in terms of a phase shift — i.e., a phase shift between the transfer of a particular sheet-representing signal through the successive stages of the shift register, on the one hand, and, on the other hand, the actual travel of the respective sheet through the now longer or shorter travel path through the machine.

This phase shift, or in other words this change of length of the sheet travel path, can be broken down into two components. The first component is constant in the sense that it is determined exclusively by the dimensions of the machine components and the designed-in changes of relative angular and other positions which are made to occur upon a changeover from the one-side mode to the two-side mode, or vice versa. The second component of the phase shift, or equivalently of the length of the sheet travel path, is variable in the sense that it is determined by the sheet format, e.g., the length of the sheet considered in direction of sheet travel through the machine.

U.S. Pat. No. 3,654,861, to Rudolph et al., issued Apr. 11, 1972, presents a detailed description of the sheet flipover action. That description makes particularly clear exactly why and to exactly what extent the length of the sheet travel path alters upon a changeover from the one-side printing mode to the two-side mode, or vice versa, and also makes clear why the path length change can be considered to consist of a constant and a variable (sheet-format-determined) component. The entire disclosure of U.S. Pat. No. 3,654,861 is incorporated herein by reference.

Such phase shifts or changes of length of the sheet travel path can also arise from the introduction of a working station into the sheet travel path for special purposes, for example a sheet-processing station such as an additional printing station for printing an additional image or image component, a drying station, or the like. If an additional working station is inserted, then in the illustrated embodiments one disconnects those of the signal detectors 19 which are affected and reconnects them, for example, further down along the shift register. Additional shift-register stages need not be used.

German Democratic Republic Pat. No. 94400, corresponding British Pat. Nos. 1,320,282, and corresponding co-pending U.S. patent application Ser. No. 414,536, filed Nov. 9, 1973, disclose the expedient of compensating for the above-described phase shift or change of length of the sheet travel path by resorting to an intermediate shift register which by means of electrical switches can be inserted into the main shift register between two stages of the main shift register to add to the length of the main shift register and which, conversely, can be removed from the main shift register to shorten the latter. The disadvantage of that expedient is that additional shift register stages are required, and the cost of these additional stages and of the means for effecting their control is fairly considerable. Also, the control arrangement, because it in effect comprises two alternative shift-register control systems, does not have a unitary circuit configuration.

SUMMARY OF THE INVENTION

It is a general object of the invention to provide a control arrangement for a multi-color rotary printing machine alternatively capable of printing in the one-side and two-side mode, or in other modes involving changes of the length of the sheet travel path.

According to one advantageous concept of the invention, this object, and others which will become more understandable from the description, below, of preferred embodiments, can be achieved by using a shift-register control system. The shift register of the control system has an information-signal input and a shift-signal input, and a plurality of shift-register stages. Signal detectors are connected to the outputs of those shift-register stages which correspond to certain locations in the path of sheet travel through the machine. These locations are the ones associated with activation and deactivation of various functional units in the printing machine, such as moving means for moving inking rollers, offset rollers, and the like, into operative positions and moving means for moving these out of operative positions, etc. In general, the activation or deactivation of a particular functional unit, or of its associated moving means, should occur when the sheet destined to be acted upon or selectively not acted upon by the unit in question has reached a certain location in the path of sheet travel. It is the shift-register stages associated with these particular locations which are provided with signal detectors devices. Sheet-representing signals pass from one shift-register stage to the next, in simulation of the travel of the respective sheets through the printing machine. As a sheet reaches successive ones of the aforementioned locations, the associated sheet-representing signal, in synchronism with such travel, reaches the corresponding shift-register stages, and is detected by the respective signal detectors connected to those stages. Each signal detector has associated with it an electromagnet moving means. Each electromagnet moving means becomes activated (for effecting activation or deactivation of a functional unit of the printing machine) when the associated signal detector detects the arrival of a sheet-representing signal at the shift-register stage to which it is connected. In this way, the various functional units of the printing machine are activated and deactivated in the proper sequence and with the proper timing, all in synchronism with the passage of sheets through the machine.

To compensate for the phase shift or change of sheet travel length resulting from a changeover from the one-side printing mode to the two-side printing mode, or vice versa, and/or resulting from a change of the sheet format (e.g., sheet length), and/or resulting from any other cause such as the introduction or removal of a working station from the sheet processing path within the machine, use is made of an adjustable transmission device. Each functional unit to be controlled by the shift-register control system is provided with a respective adjustable transmission device, or with two such devices, one for effecting activation and the other for effecting deactivation of the associated functional unit. The adjustable transmission device affords a long storage range and a relatively short working range and is connected with a respective electromagnet engaging device in turn connected to the read-out device of the appropriate shift-register stage.

The electromagnet engaging device causes engagement to be effected between parts of the adjustable transmission, thereby setting up the transmission device for force transmission at a later appropriate time. The transmission is adjustable for adjusting the time delay between activation of the electromagnet engaging device and activation (or de-activation) of the functional unit moved by the transmission. Furthermore, the train of shift signals applied to the shift-signal input of the control shift register is resolved into non-equal components of a 360° work cycle of the machine or, expressed in other words, is comprised of a plurality of trains of shift signals, with the trains being phase-shifted relative to each other by an angle not equal to one-half their period. With these expedients it is possible to compensate for both the aforedescribed constant and variable components of the coordination-loss phase shift or change of sheet-travel path length.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
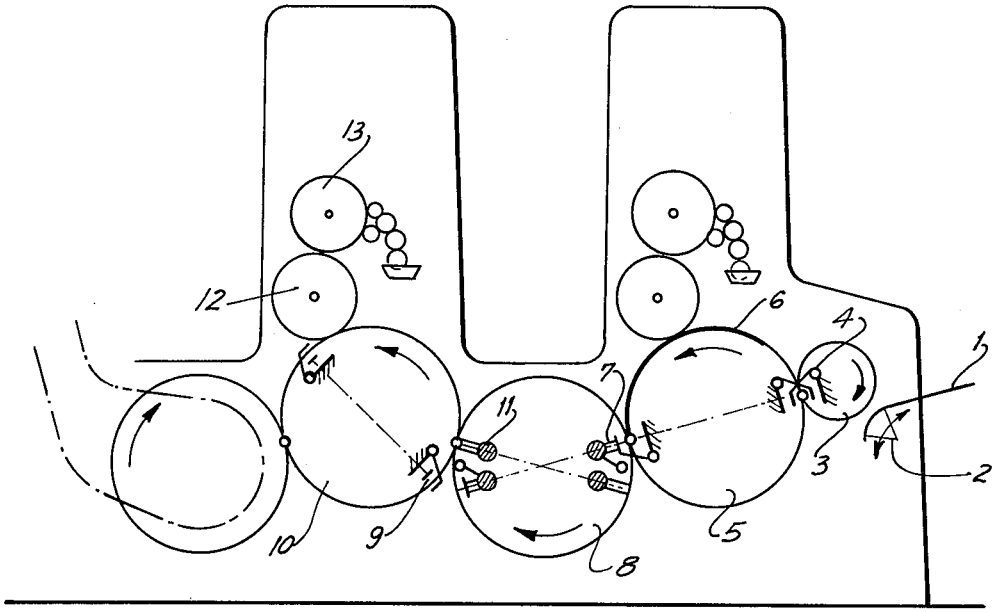
FIG. 1 depicts a multi-color rotary printing machine set up for one-side printing, for printing two colors on one side of a sheet.
Figure 2:
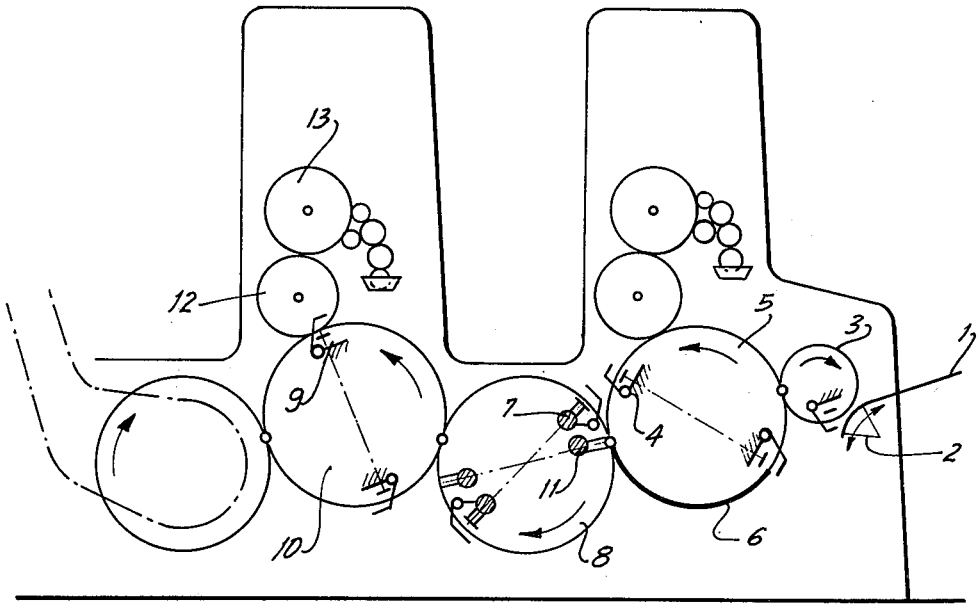
FIG. 2 depicts the multi-color rotary printing machine of FIG. 1 set up for two-side printing, for printing two images of the same or different colors on opposite sides of a sheet.

The rotary printing machine shown in FIGS. 1 and 2 is set up in FIG. 1 for printing two component images at successive times at successive printing stations upon one side of a sheet 6, and is set up in FIG. 2 for printing two images at successive times at successive printing stations upon respective opposite sides of the sheet 6.

The sheet 6 to be printed is laid onto a feedin table 1, is engaged by a conventional infeed gripper 2 and transferred onto the infeed drum 3. The infeed drum 3 feeds the sheet 6 into engagement with the first gripper device 4 of the printing cylinder 5 of the first printing station. After the sheet 6 has been printed upon in the first printing station, it is fed to the transfer drum 8. Because in FIG. 1 the printing machine is shown set up for one-side printing, the leading end of the sheet 6, as it enters into the region of tangency between the first printing roller 5 and the transfer drum 8, is engaged by the first gripper device 7 of the transfer drum 8. In the one-side printing mode, the transfer drum 8 does not act as a flip-over drum. In this mode the side of sheet 6 which contacts the periphery of printing roller 5 is not the side which subsequently contacts the periphery of transfer drum 8. The drums and rollers rotate in the directions indicated by the arrows. The sheet 6 is fed by the transfer drum 8 to the printing cylinder 10 of the second printing station, and the leading edge of the sheet is engaged by the first gripper device 9 of the printing cylinder 10. In particular, as the leading end of the sheet 6 enters into the region of tangency between the transfer roller 8 and the second printing cylinder 10, the machine is set up so that the first gripper device 9 of the second printing cylinder 10 is located in this region of tangency.

The action is different when the machine is set up for two-side printing, as in FIG. 2. In FIG. 1 the relative angular positions of printing roller 5 and transfer drum 8 were such that, as the leading end of sheet 6 entered the region of tangency, the gripper device 7 on the transfer drum 8 was located in such region, but the relative rotational positions of roller 5 and drum 8 are different in FIG. 2. In FIG. 2, the drum 8 has been turned through an angle, determined firstly by the angular spacing between the gripper device 7 and the suction device 11 and determined secondly by the angular extension of the sheet 6. When, in FIG. 2, the leading end of sheet 6 enters into the region of tangency between printing roller 5 and transfer drum 8, such leading end is not engaged. Instead sheet 6 continues to ride on the periphery of printing roller 5 until the trailing end of the sheet 6 enters the region of tangency. When this occurs, such trailing end is seized by the suction device 11, which pulls the sheet 6 off the printing roller 5 and flips it over onto the transfer drum 8. The aforementioned angle is such that when the trailing end of sheet 6 enters the region of tangency between printing roller 5 and transfer drum 8 the suction device 11 will be present in the region.

Further details of the flip-over action may be had from the aforementioned U.S. Pat. No. 3,654,861, the entire disclosure of which is incorporated herein by reference.

It will be clear that the length of the sheet travel path through the printing machine will, in general, be greater for the two-side printing mode than for the one-side printing mode, because of the flip-over action just described. In the mode shown in FIG. 1, the sheet travels on printing roller 5 a distance equal to half the circumference of roller 5, whereas in the mode shown in FIG. 2 the sheet travels on printing roller 5 a distance equal to half the circumference of roller 5 plus an additional distance equal to the length of the sheet itself.

The aforementioned change in the relative angular positions of first printing roller 5 and transfer drum 8, required when changing from the one-side mode of FIG. 1 to the two-side mode of FIG. 2 (or vice versa), applies not only to the transfer drum 8, but usually also to all rotating sheet-transporting members downstream of transfer drum 8. Specifically, when changing from one mode to the other, and changing the angular position of transfer drum 8 while holding printing roller 5 fixed, it becomes necessary to effect a corresponding angular shift of the second printing roller, so that a gripper device thereon be located in the region of tangency between the transfer drum 8 and the second printing roller 10 as the new leading end of the flipped-overr sheet 6 on transfer roller 8 enters such region of tangency.

As already indicated, various functional units within the printing machine (offset rollers, inking rollers, etc.) must be moved into activated and deactivated positions, or in other manner be activated and deactivated, in synchronism with the arrival of the sheet to be printed at predetermined locations along the travel path of the sheet through the printing machine; these locations may be located upstream of the respective functional units by a considerable distance, for example in order to compensate for the activation or deactivation times of the various functional units. When the changeover from the one-side printing mode of FIG. 1 to the two-sde printing mode of FIG. 2 is made, the sheet to be printed will arrive at all locations downstream of the transfer drum 8 later than in the one-side printing mode, due to the longer sheet travel path. Conversely, when a changeover from the two-side mode to the one-side mode is made, the sheet to be printed will arrive at all locations downstream of the transfer drum 8 earlier than in the two-side printing mode. Accordingly, all control signals initiated by arrival of the sheet at predetermined locations downstream of the transfer drum 8 will be generated either too early or too late, after a change of printing mode has been performed.

When a control shift register is employed, the passage of the sheet-representing signal through successive shift-register stages should simulate the travel of the corresponding sheet along the sheet travel path. In other words, the actual travel of the sheet should proceed in phase with the passage of the associated sheet-representing signal through successive stages of the shift register. If one changes from one mode to the other, a phase shift is introduced; likewise, if one changes sheet formats (e.g., lengths) in the two-side printing mode, a phase shift is introduced. This phase shift, corresponding to the change in length of the sheet travel path, like the sheet travel path length change, can be considered to be composed of two components: the first, a constant component determined by the geometry of the machine; and the second, a variable component determined by the dimensions of the sheet to be printed upon.

Figure 3:
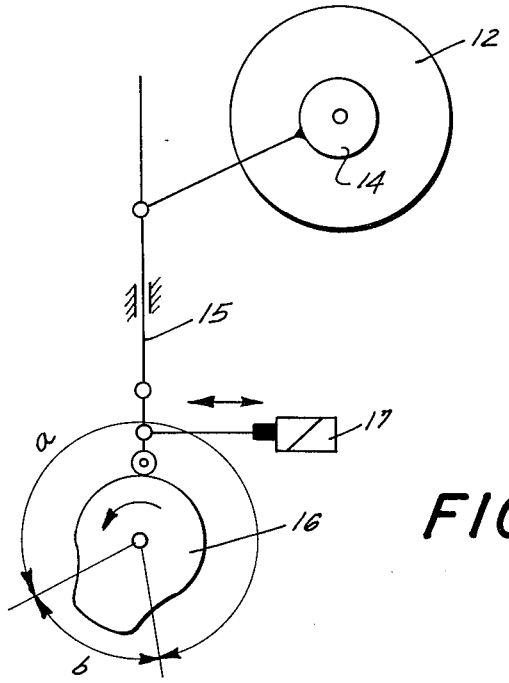
FIG. 3 schematically depicts the adjustable transmission for moving a functional unit of the printing machine into an activated or deactivated position.
Figure 4:
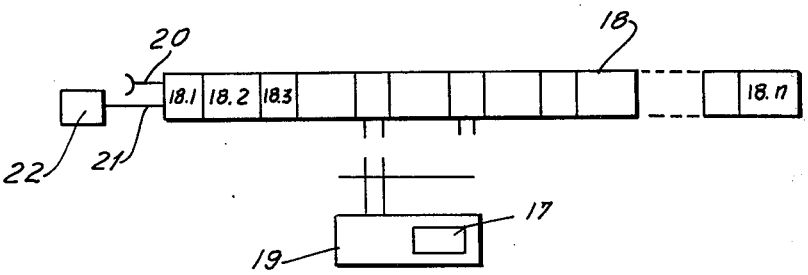
FIG. 4 depicts the control shift register.

The activation and deactivation of the individual functional units of the printing machine in synchronism will travel of a sheet to be printed through the machine is performed under the combined control of the shift register schematically depicted in FIG. 4 and the adjustable transmission schematically depicted in FIG. 3.

The adjustable transmission of FIG. 3 will be described first, and for the sake of explanation with specific regard to the offset roller 12. In the case of the offset roller 12, activation and deactivation of this functional unit are respectively constituted by throw-on and throw-off, i.e., bringing offset roller 12 into engagement with plate cylinder 13 and printing roller 10 or bringing offset roller 12 out of such engagement. For movement between such engaged and disengaged positions, the rotation shaft of the offset roller 12 is mounted on an eccentric mounting 14, schematically depicted in FIG. 3. Rotation of the eccentric mounting 14 through a relatively small angle causes the offset roller to be brought into or taken out of engagement with plate cylinder 13 and printing roller 10. Rotation of the eccentric mounting 14 through this small angle is accomplished by means of an articulate linkage-rod arrangement, schematically depicted in FIG. 3 as being comprised of an inclined first linkage rod extending from the eccentric mounting 14 to a pivot journal on a generally vertical second linkage rod 15. The second, generally vertical linkage rod 15 is mounted for vertical shifting through a schematically illustrated stationary guide. When the vertically oriented linkage rod 15 is pushed upwards (as viewed in FIG. 3), motion is transmitted to the eccentric mounting 14 via the inclined linkage rod, and the eccentric mounting 14 moves the offset roller 12 into engagement with printing and plate cylinders 10, 13. The vertical linkage rod 15 is pushed upwards in this way by a cam disk 16. The vertical linkage rod 15 has a pivoting lower section at the bottom end of which is mounted a cam-follower roller. The pivoting lower section of the vertical linkage rod 15 has an operative and an inoperative position. The operative position is shown. In the operative position of the pivoting lower section of the linkage rod 15, the cam-follower roller rides on the periphery of the cam disk 16. In the inoperative position of the pivoting lower section of the linkage rod 15, the cam-follower roller is out of the effective range of the periphery of the cam disk 16 and will not be engaged by the cam disk 16 during any part of the rotation of the cam disk. It is to be understood that in FIG. 3 the depiction is only schematic. It is to be understood that the electromagnet armature shaft slides with a considerable amount of play, so that it can be tilted up or down without doing harm to the structure of the electromagnet, and so that it can be pulled out or pushed in a certain distance (during rising of linkage rod 15) without doing harm to the structure of the electromagnet.

Whether the pivotable lower section of linkage rod 15 is in the operative or inoperative position — i.e., whether the cam-follower roller at the end of linkage rod 15 does or does not ride upon the periphery of rotating cam disk 16 — is determined by the state of activation of the electromagnet 17. When electromagnet 17 is not energized, the linkage rod is in the inoperative position; when electromagnet 17 is energized, the linkage rod 15 is in the operative position.

The cam disk 16 is rotated in synchronism with the operation of the printing machine. For example, the cam disk 16 may be provided on the rotation shaft of the first printing cylinder 5, or upon the rotation shaft of any convenient rotating component of the printing machine. Preferably, the cam disk 16 will be caused to perform one revolution per machine cycle, e.g., per rotation of one of the printing rollers.

The angular extent of the working lobe on cam disk 16 is designated *b*, whereas the angular extent *a* of the remainder of the cam disk periphery is taken up by a non-working portion. The cam disk 16 is mounted on a rotary shaft for rotation therewith, in synchronism with the operation of the printing machine, as just described. However, the cam disk 16 advantageously is furthermore mounted for angular adjustment with respect to the rotary shaft upon which it is mounted. For example, the cam disk 16 can be mounted on the shaft by means of a locking screw which can be loosened to permit the cam disk 16 to be angularly shifted relative to its rotation axle, whereupon the locking screw will be tightened. The angular extent *a* of the non-working part of the cam disk 16 is considerably greater than the angular extent *b* of the working part of the cam disk 16, thereby maximizing the range of angular adjustment of the cam disk 16 relative to the shaft upon which it rotates.

It should be clear that this angular adjustability of the cam disk 16 relative to its rotation shaft makes possible the establishment of any desired time delay (expressed as a fraction of a machine operating cycle) between, on the one hand, the energization of electromagnet 17 and, on the other hand, the movement of offset roller 12 from the deactivated (thrown-off) to the activated (thrown-on) position. This makes possible infinite-adjustability compensation for the variable component of the aforedescribed phase shift.

The following should be considered. Cam 16 has two sectors, sector *a* and sector *b*. The cam rotates not under the control of electromagnet 17. If the electromagnet 17 is energized at such a moment that the cam-follower roller comes into contact with the cam surface just adjacent to sector *b*, then the activation of the eccentric 14 will not occur until the cam-follower roller rides up on sector *b*. Now, if the timing of the energization of electromagnet 17 is changed so that the cam-follower roller comes into contact with the cam surface for example right in the middle of sector *a*, there is no affect upon the timing of the activation of eccentric 14. As before, such activation will not occur until the cam-follower roller rides up on sector *b*. In other words, merely changing the moment at which the electromagnet 17 is energized only results in a change of the moment at which the cam-follower roller first engages sector *a*. Whether sector *a* is thusly engaged right near the start of sector *b* or far from the sector *b*, makes no difference, because nothing occurs during the time that the cam-follower roller is idling along sector *a*. Changing the moment of energization of electromagnet 17 accordingly merely has the effect of changing the length of the time interval during which the cam-follower roller is in contact with sector *a*, idling along waiting for sector *b* to be reached.

In the preferred embodiment, the adjustable transmission of FIG. 3 is operative only for causing the offset roller 12 to move from the unactivated to the activated position, and does not effect the opposite movement. Instead, to effect the opposite movement, there is provided another (but non-illustrated) such adjustable transmission, likewise provided with a respective electromagnet 17 which when energized causes the associated linkage to turn the eccentric mounting 14 in the opposite direction, thereby returning the offset roller 12 to the unactivated (thrown-off) position. Upon the return of the eccentric mounting 14 to the unactivated position, the eccentric mounting 14 will drive the linkage rod 15 of the illustrated adjustable transmission shown in FIG. 3 back down to its starting position. The desirability (as opposed to the need) for a second transmission is to make possible deactivation of the functional unit independently of activation of the functional unit. Thus, for example, it is possible to vary the length of time during which a particular functional unit will remian activated; this would have meaning in certain situations. If a second transmission were not employed, then the angular span of cam lobe *b* would predetermine the time interval during which the associated functional unit remains activated, and there would be no way of varying this time interval without, for example, replacing one cam 16 with another having a cam lobe of different angular span.

It is to be understood that the exact details of the adjustable transmission are not critical, and that an enormous variety of conventional linkages and transmissions can be employed. Likewise, the expedient of providing two such linkages and two cooperating electromagnets for respectively activating and deactivating one functional unit (e.g., the offset roller 12) is only exemplary.

For the sake of simplicity, only one functional unit (the offset roller 12) is depicted. However, it will be understood that a plurality of such functional units are involved, e.g., other offset rollers, plate cylinders, ink-applying cylinders, and the like. It is likewise to be understood that each such functional unit is provided with a respective pair of oppositely acting electromagnetcontrolled linkages. The linkage of each pair of linkages associated with one functional unit is provided with a respective electromagnet 17. It will be understood that the linkages need not all be of the same configuration, and may advantageously have different configurations.

Each electromagnet 17 forms part of a respective signal detector stage 19. Each signal detector stage 19 is connected to one of the shift-register stages 18.1 to 18.n. The shift register 18 has an information-signal input 20 and a shift-signal input 21. The input 20 receives sheet-representing signals from a (non-illustrated) sheet detector, which may be of any conventional type, e.g., photoelectric, pneumatic, feeler-type, etc. When a sheet 6 to be printed enters the printing machine and passes the sheet detector, the sheet detector applies a sheet-representing pulse to the input 20 of the shift register. A pulse generator 22 applies a train of shift pulses to the shift-signal input 21 of the shift register 18.

The shift pulses (discussed in greater detail below) are generated in synchronism with machine operation. For example, the pulse generator 22 can be comprised of a perforated disk mounted for rotation on a rotary shaft of the printing machine, with a cooperating photoelectric detector generating a shift pulse each time one of the disk perforations passes by the detector. Other synchronizers can of course be used.

Because of the application of the machine-synchronized shift pulses to the input 21 of the shift register 18, the sheet-representing signal applied to input 20 of the shift register advances from one shift-register stage to the next in synchronism with travel of the associated sheet through the printing machine. When the sheet to be printed reaches certain predetermined locations, corresponding to predetermined ones of the shift-register stages 18.1 to **18.*n*, certain ones of the functional units should be activated or deactivated. Connected to the output of each of these predetermined shift-register stages is one respective signal detector 19, incorporating one electromagnet 17** associated with either an activating linkage arrangement or a deactivating linkage arrangement. Accordingly, assuming that there is proper coordination and synchronization between the actual travel of the sheet to be printed through the printing machine, on the one hand, and the advancement of the sheet-representing signal through the successive shift-register stages, on the other hand, then as the sheet travels through the printing machine the various functional units of the printing machine will become activated and deactivated in the proper sequence and with proper timing.

The train of shift pulses generated by pulse generator 22 does not consist of pulses having equal spacing (expressed in terms of machine cycles). Instead, they have a non-equal or non-symmetrical spacing. For example, two such shift pulses can be generated per machine cycle (e.g., per revolution of a rotating machine components), with the first pulse being generated at the 0°, 360°, 720° times within the cycle, and the second pulse being generated, for example, at the 165°, 525°, 885° times within the cycle. In other words, the train of shift pulses can be composed of a plurality of superimposed component trains of shift pulses, the pulses of each component train having a frequency of one per machine cycle, but the component trains being phase-shifted relative to each other by an angle other than one-half the period of the pulse trains. Such superimposed trains of shift pulses can be generated very easily, for example simply by making use of a perforated synchronizing disk having correspondingly disposed perforations, or by making use of a plurality of perforated synchronizing disks each having equally spaced perforations adapted to produce a one-pulse-per-machine-cycle pulse train and mounted on a common rotation shaft but angularly adjustable relative to each other on such shaft.

If the printing machine is changed over from the one-side printing mode to the two-side printing mode, or vice versa, then as explained before it is necessary to perform an angular shifting of the transfer drum 8 and of all those rotary sheet-transporting components which are located downstream of the transfer drum 8. It has already been explained that this mode changeover results in the development of a phase shift between the travel of the sheet through the printing machine, on the one hand, and the travel of the corresponding sheet-representing signal through a conventional control shift register, on the other hand. It has also been explained that this phase shift can be considered to consist of a constant component, determined exclusively by the geometry of the parts of the printing machine, and of a variable component, determined exclusively by the sheet format (e.g., the length of the sheet considered in direction of sheet travel).

The constant component of the mode-changeover phase shift is compensated for by shifting all those signal detectors 19 associated with sheet-travel-path locations downstream of the printing roller 5 by a number of shift-register stages corresponding as closely as possible to the change in the length of the sheet travel path. Ordinarily, the constant phase shift angle (e.g., 165°) is a fixed angle which is not changed during the lifetime of the apparatus. The employment of the non-uniformly generated shift pulses has the advantageous result that, if the signal detectors 19 are shifted by an odd number of shift-register stages (including the number one), then the compensatory phase shift thereby achieved is equal to a whole number (including one) of machine cycles plus a fraction of a machine cycle, e.g., the fraction corresponding to 165° of a 360° cycle. Since this constant mode-changeover phase shift is known in advance, it is a simple matter to select the phase shift (e.g., 165°) between the two superimposed one-pulse-per-cycle shift-pulse trains in correspondence thereto. Ordinarily, the constant phase shift angle (e.g., 165°) is a fixed angle which is not changed during the lifetime of the apparatus.

To understand the importance in the illustrated embodiment, of shifting by an odd number of stages, imagine that only a single sheet travels through the entire printing machine. Accordingly, only one sheet-representing signal will be registered in the shift register. As this single sheet enters the machine, the single sheet-representing signal is registered by the first shift-register stage. As this single sheet travels through the machine, the single sheet-representing signal is registered by successive ones of the shift-register stages.

Figure 5:
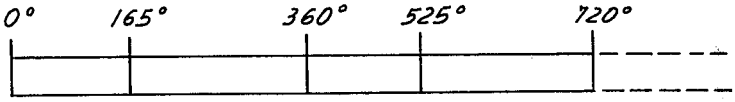
FIG. 5 depicts the timing of the shift-signal train.

The advancement of this single sheet-representing signal from one shift-register stage to the next occurs in synchronism with the generation of successive ones of the shift pulses shown in FIG. 5.

Assume that the shift pulse generated at the 0° moment effects registration of the sheet-representing signal by shift-register stage 18.1. The sheet-representing signal will remain registered in stage 18.1 until the generation of the next shift signal, which occurs at the 165° moment, whereupon the sheet-representing signal advances to shift-register stage 18.2. The sheet-representing signal remains registered in stage 18.2 until the third such shift signal is generated, at the 360° moment, and so on.

Now consider: The sheet-representing signal was stored in stage 18.1 for a time interval corresponding to 165° of the 360° cycle, whereas the sheet-representing signal was stored in stage 18.2 for a longer time interval corresponding to the remaining 195° of the 360° cycle.

It will be understood that the same relationship exists as between stages 18.3 and 18.4 or, in general terms, between the odd-numbered stages and the even-numbered stages.

Thus, there is a distinguishability between the odd-numbered stages, on the one hand, and the even-numbered stages, on the other hand.

It follows necessarily that the total number of shift-register stages by which one of the reading devices 19 is displaced is not the sole criterion of how great a compensatory phase shift component is introduced. Another criterion is whether such total number is even or odd.

It is believed that the foregoing explanation makes clear that the advantages set forth at the top of page 27 are in fact achieved, and necessarily so.

Because of the unequal subdivision of the shift pulse train of FIG. 5, each sheet-representing signal travelling along the shift register will dwell for different time intervals in different ones of the shift-register stages. For example, if the 0° shift pulse of FIG. 5 effects registration of a sheet-representing signal by the first stage 18.1, such registration will persist only until the 165° pulse whereupon the signal will become registered by stage 18.2. In contrast, the registration by stage 18.2 will persist until the 360° shift pulse. Thus, the stage 18.1 (and also 18.3, 18.5, etc.) registers the sheet-representing signal for a time interval corresponding to 165° of a machine cycle, whereas stage 18.2 (and also 18.4, 18.6, etc.) registers the sheet-representing signal for a time interval corresponding to 195° of the machine cycle. Thus, the use of the non-symmetrically subdivided shift pulse train creates the possibility of introducing compensatory phase shift. The utilization of non-symmetrical spacing for the pulse train is only for the compensation of the fixed component of the change in the sheet travel length arising upon a printing mode changeover. The change in the length of the travel path of the sheet includes a component which is dependent upon the length of the sheet and a further component which is determined by the dimensions of the printing apparatus itself and which therefore is invariable. Since the unsymmetrical division of the machine operating cycle is associated exclusively with the invariable component of the path length change, no particular value of the sheet length could necessitate a symmetrical division of the operating cycle.

Moreover, the shifting of the signal detector devices 19 corresponding to those path locations downstream of printing roller 5, to compensate for the constant component of the mode-changeover phase shift, can be accomplished by throwing a single mechanical switch or lever; all the multi-position switches connecting the inputs of the signal detectors 19 to the outputs of the shift-register stages 18.1 to 18.n involved in the phase shift can be ganged together for simplicity of activation. Instead of manual activation, the ganged-together switches can be controlled automatically by a linkage connected to the transfer drum 8, for activation automatically when the angular position of the transfer drum 8 is changed for a mode changeover.

The variable (sheet-format-dependent) component of the mode-changeover phase shift is conpensated by effecting an appropriate angular adjustment of the cam disks 16 relative to the rotation shafts upon which they are mounted. Advantageously, all the cam disks 16 can be mounted on a single rotation shaft, but with those cam disks 16 which are associated with path locations involved in mode-changeover phase shifts being ganged together for joint angular adjustment relative to the common rotation shaft. In that event, all the cam disks 16 involved in the phase shift could be adjusted manually by a single calibrated dial, for example directly calibrated in units of sheet length. More realistically, however, it will not be possible to position all the cam disks 16 involved in the phase shift upon a single rotation shaft, because of the separation in space of the associated functional units. However, suitable conventional linkages could be provided, interconnecting these cams, to effect the joint angular adjustment, for compensating the variable phase shift component. As another possibility, each cam disk 16 in a pair of adjustable transmissions, or even each cam disk 16 separately, could be adjusted by a separate adjusting dial calibrated directly in units of sheet length. With any of these aforementioned alternatives involving adjusting dials calibrated directly in units of sheet length, there will advantageously be furthermore provided some kind of locking means for holding the cam disks 16 involved in the phase shift in place in their selected angular positions relative to their rotation shaft or respective rotation shafts. This could be a simple shaft key member axially shiftable between a locking position in which a portion of the shaft key wedges in between the cam disk and the rotation shaft to lock the cam disk in place and an unlocking position in which the shaft key member is shifted axially out of wedging engagement, in order to permit angular adjustment of the cam disk relative to its rotation shaft under the control of the calibrated dial described above. Other such expedients are also encompassed within the scope of the invention. Of course, in theory, each cam could be provided with a simple locking screw which would be separately loosened for adjustment of that particular cam disk and then re-tightened after the angular adjustment.

The compensating phase shift depends upon the characteristic delay between the various shift-register stages, but not exclusively upon the characteristic delay. The compensating phase shift depends upon the following factors, in combination: the characteristic delay, the total number of register stages by which the device 19 is shifted for compensatory purposes, and finally and not least important the setting of the adjustable transmission of FIG. 3. Advantageously, the cam 16 is mounted non-rotatable relative to one of the cylinders which must be angularly adjusted to effect a printing-mode changeover; in that way, the cam disk 16 will be angularly adjusted exclusively by virtue of the fact that it is mounted on a cylinder which must be angularly adjusted to effect a printing mode changeover.

As already explained, for each functional unit (such as the offset roller 12), there is provided a pair of adjustable transmissions, each having its own electromagnet 17. The electromagnet 17 for the transmission which effects activation could be activated by a positive signal change, and the electromagnet 17 for the transmission which effects the deactivation could be activated by a negative signal change, i.e., the magnets would be activated alternately.

If there is made a change from the one-side printing mode to the two-side printing mode, then, as already described, those machine components downstream of the printing cylinder 5 of the first printing station must be angularly adjusted. This adjustment angle is equal to the sum of the constant and the variable angle corresponding to the increase in the length of the sheet travel path in the two-side printing mode. The constant phase shift is compensated by shifting the signal detector 19 to a shift-register stage corresponding to the phase shift. The variable phase shift, determined by the differing formats of sheets which can be processed by the printing machine, is compensated by the non-symmetrical subdivision of the machine operating cycle and the corresponding subdivision of the cam disk into the long storage region *a* and the short work region *b*. The activation of the magnet 17 with differing sheet formats to be handled always occurs in the storage range *a* of the cam disk 16. The unsymmetrical subdivision of the machine operating cycle determines differently long storage times of the signal conditions in the various stages of the shift register.

In the event of a change of the signal condition of the respective shift-register stage, the produced signals for the activation of the magnet 17, for all sheet formats which can be handled, are made available by the same shift-register stage so long as the compensatory phase shift is necessitated by a change of sheet length only.

It will be understood that each of the elements described above, or two or more together, may also find a useful application in other types of circuits and constructions differing from the types described above.

While the invention has been illustrated and described as embodied in a multi-color rotary printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art fairly constitute essential characteristics of the generic or specific aspects of this invention.

What is claimed as new and desired to be protected by Letters Patent is set forth in the appended claims:

1. In a control system for a multicolor rotary printing machine comprised of a plurality of independently actuatable functional units arranged along the path of travel of sheets through the machine, the machine being of the type capable of printing in a one-side printing mode and in a two-side printing mode in which the sheet path length is longer than in the one-side mode, the path length change resulting upon a printing mode changeover being composed of a fixed component determined by the dimensions of the parts of the machine and a variable component determined by the length of the sheets to be printed, the control system including, in combination, a plurality of actuating means each operative for effecting a predetermined change of state of a respective one of said functional units, each comprised of a first moving means and a second moving means, the first moving means having an activated and an unactivated setting, the second moving means performing in synchronism with machine operation a cycle of motion composed of a longer non-working portion and a shorter working portion, the second moving means being operative for effecting a change of the state of activation of a respective functional unit if and only if the respective first moving means is in the activated setting during the working portion of the cycle of the second moving means; means for causing each second moving means to undergo a sheet-length-dependent phase shift of its cycle of motion upon a printing mode changeover, whereby to compensate for the variable component of the sheet path length change; a shift register; means for applying to the information-signal input of the shift register a sheet-representing signal; means for causing the sheet-representing signal to travel through the successive shift-register stages in simulation of travel of a sheet through the machine, comprising means for applying to the shift-signal input of the shift register a train of shifting signals synchronized with the cycles of machine operation, the train being comprised of a plurality of component pulse trains phase shifted relative to each other by a fixed angle other than 180° so that a sheet-representing signal will be registered by different ones of the stages for different respective time intervals; a plurality of signal detectors each connected to a respective shift-register stage and operative upon detection of the arrival of a sheet-representing signal at the respective stage for causing a respective first moving means to assume the activated setting; and means operative upon a printing mode changeover for effecting compensatory disconnections of predetermined ones of the signal detectors from the respective shift-register stages and reconnections of such units to predetermined other ones of the stages to compensate for the fixed component of the sheet path length change.

* * * * *